US008919637B2

(12) United States Patent
Kim et al.

(10) Patent No.: US 8,919,637 B2
(45) Date of Patent: Dec. 30, 2014

(54) UNMANNED PARCEL STORAGE APPARATUS CAPABLE OF DYNAMICALLY ALLOCATING STORAGE SPACE AND METHOD OF USING THE SAME

(71) Applicant: Electronics and Telecommunications Research Institute, Daejeon-si (KR)

(72) Inventors: Dong-Ho Kim, Daejeon-si (KR); Jae-Gwan Song, Daejeon-si (KR); Hyon-Gook Kim, Chungcheongnam-do (KR); Hoon Jung, Daejeon-si (KR); Jong-Heung Park, Daejeon-si (KR)

(73) Assignee: Electronics and Telecommunications Research Institute, Daejeon-Si (KR)

( * ) Notice: Subject to any disclaimer, the term of this patent is extended or adjusted under 35 U.S.C. 154(b) by 0 days.

(21) Appl. No.: 13/858,307

(22) Filed: Apr. 8, 2013

(65) Prior Publication Data

US 2013/0264381 A1 Oct. 10, 2013

(30) Foreign Application Priority Data

Apr. 9, 2012 (KR) ..... 10-2012-0036919

(51) Int. Cl.
*A47G 29/14* (2006.01)
*A47G 29/122* (2006.01)
*G07F 17/12* (2006.01)

(52) U.S. Cl.
CPC ..... *A47G 29/122* (2013.01); *A47G 29/141* (2013.01); *G07F 17/12* (2013.01); *A47G 2029/148* (2013.01)
USPC ..... 232/24; 220/529; 340/569

(58) Field of Classification Search
CPC ..... A47G 29/1201; A47G 29/1209; A47G 29/1218; A47G 29/122; A47G 29/14; A47G 29/16; A47G 29/30; A47G 2029/12; A47G 2029/122; A47G 2029/14; A47G 2029/141–2029/143; A47G 2029/148; B65D 25/04; G07C 9/00571; G07C 9/00912
USPC ..... 232/17, 19, 24, 25, 45; 340/5.73, 545.6, 340/569; 220/524, 529
See application file for complete search history.

(56) References Cited

U.S. PATENT DOCUMENTS 693,770 A * 2/1902 Wright et al. ..... 232/17
4,894,717 A * 1/1990 Komei ..... 348/150
5,172,970 A * 12/1992 Momose et al. ..... 312/329

(Continued)

FOREIGN PATENT DOCUMENTS

DE 101 25 601 A1 12/2002
KR 10-2010-0101350 A 9/2010
KR 10-1024620 B1 3/2011

*Primary Examiner* — William Miller
(74) *Attorney, Agent, or Firm* — Rabin & Berdo, P.C.

(57) ABSTRACT

An unmanned parcel storage apparatus capable of dynamically allocating storage spaces and a method of using the unmanned parcel storage. A storage method of the unmanned parcel storage apparatus determines a position and a size of a desired storage space to be allocated. Based on the determination result, a moving unit adds or removes a partition to create the desired storage space, and moves a delivery item to the created storage space for the storage purpose. Accordingly, it is possible to efficiently use a space in a storage unit and thereby store more number of delivery items in the same storage unit. In addition, the moving unit processes the allocation of storage spaces, and delivery, loading and discharging of the delivery items, and therefore the user's convenience of use can be enhanced.

6 Claims, 6 Drawing Sheets

(56) References Cited

U.S. PATENT DOCUMENTS

| | | | | | |
|---|---|---|---|---|---|
| 5,223,829 | A * | 6/1993 | Watabe | 340/5.73 |
| 5,231,272 | A * | 7/1993 | Mardon | 235/382 |
| 5,386,462 | A * | 1/1995 | Schlamp | 379/93.12 |
| 5,774,053 | A * | 6/1998 | Porter | 340/568.1 |
| 5,979,750 | A * | 11/1999 | Kindell | 232/19 |
| 6,010,064 | A * | 1/2000 | Umeda et al. | 235/375 |
| 6,323,782 | B1 * | 11/2001 | Stephens et al. | 340/10.31 |
| 6,715,669 | B2 * | 4/2004 | Hara | 232/45 |
| 7,191,932 | B2 * | 3/2007 | Fobbe et al. | 232/19 |
| 7,337,944 | B2 | 3/2008 | Devar | |
| 2001/0045449 | A1 * | 11/2001 | Shannon | 232/19 |

* cited by examiner

UNMANNED PARCEL STORAGE APPARATUS CAPABLE OF DYNAMICALLY ALLOCATING STORAGE SPACE AND METHOD OF USING THE SAME

CROSS-REFERENCE TO RELATED APPLICATION

This application claims the benefit under 35 U.S.C. §119 (a) of Korean Patent Application No. 10-2012-0036919, filed on Apr. 9, 2012, the entire disclosure of which is incorporated herein by reference for all purposes.

BACKGROUND

1. Field

The following description relates to a method for efficiently using an unmanned parcel storage box for use in apartment houses and a storage apparatus enabling an efficient use of a storage space.

2. Description of the Related Art

With the rapid change of consumption patterns of traditional offline trading to online transactions, such as online shopping, the quantity of transported delivery items, such as parcels or packages, has been sharply increased. However, it may be difficult to deliver delivery items if a recipient is absent. Moreover, due to robbery or other criminal acts committed by criminals disguised as a delivery person, recipients may hesitate to personally receive a delivery item from an unacquainted person. Therefore, in order to resolve such drawbacks, an unmanned parcel storage apparatus has been developed.

A variety of products, which are domestically and internationally commercialized, related to an unmanned parcel storage apparatus, are used in public places, such as apartments, subway stations, and public agencies. These products, each, may consist of a number of lockers, which are typical personal storage boxes, arranged in a metal frame, and further include an information s processing device to enable the lockers to be utilized to store a delivery item for a certain period of time or to deliver the delivery item to another user.

Such products have similar functions and structures to each other, and their storage spaces are fixed to a predefined size, regardless of a size of delivery items. The delivery items to be stored in the conventional unmanned parcel storage apparatus may include standard-sized mails, such as letters, and various types of parcels and packages, which vary in sizes. Therefore, the conventional unmanned parcel storage apparatus that stores the different-sized delivery items in the same storage space may be inefficient in terms of space utilization.

In order to overcome the drawbacks described above, unmanned parcel storage apparatuses have been developed to have storage space divided into small-sized space, medium-sized space, and large-sized space in consideration of the size of delivery items. However, in these unmanned parcel storage apparatuses, the sizes of the storage spaces are limited only to three different types, and hence such apparatuses cannot be regarded as effectively reflecting on the size of delivery items.

SUMMARY

The following description relates to an unmanned parcel storage apparatus with a variable structure in which sizes of storage spaces can be changed in real time, and a method of using the unmanned parcel storage apparatus.

In one general aspect, there is provided an unmanned parcel storage apparatus capable of dynamically allocating storage spaces, the apparatus comprising: a post slot through which a delivery item is inserted and discharged; a storage unit configured to comprise a plurality of storage spaces which are variable in size; a control unit configured to dynamically allocate the storage spaces in the storage unit and to determine disposition of the delivery items; and a moving unit configured to create the space storages and move the delivery item in response to an instruction from the control units.

In another general aspect, there is provided a storage method of an unmanned parcel storage apparatus, the storage method comprising: receiving an instruction to set a task type of the unmanned parcel storage apparatus to storage of a delivery item; receiving information regarding the delivery item; identifying a size of the delivery item, and allocating a storage space with a variable size in a storage unit of the unmanned parcel storage apparatus according to the size of the delivery item; receiving the delivery item; and moving and loading the delivery item in the storage space.

Other features and aspects will be apparent from the following detailed description, the drawings, and the claims.

Figure 1A:
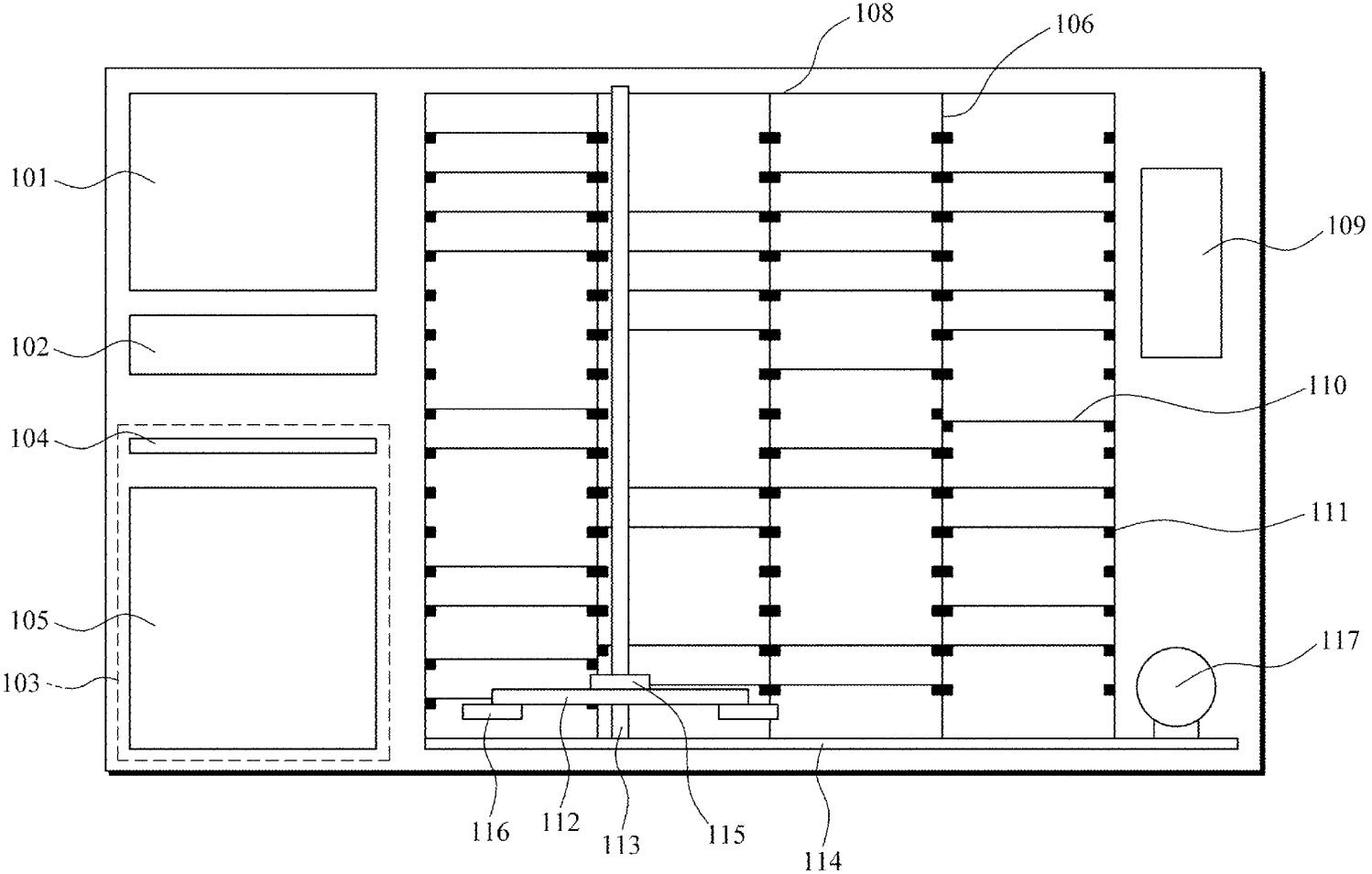
FIG. 1A is a front view of an unmanned parcel storage apparatus capable of dynamically allocating storage spaces according to an exemplary embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 1B:
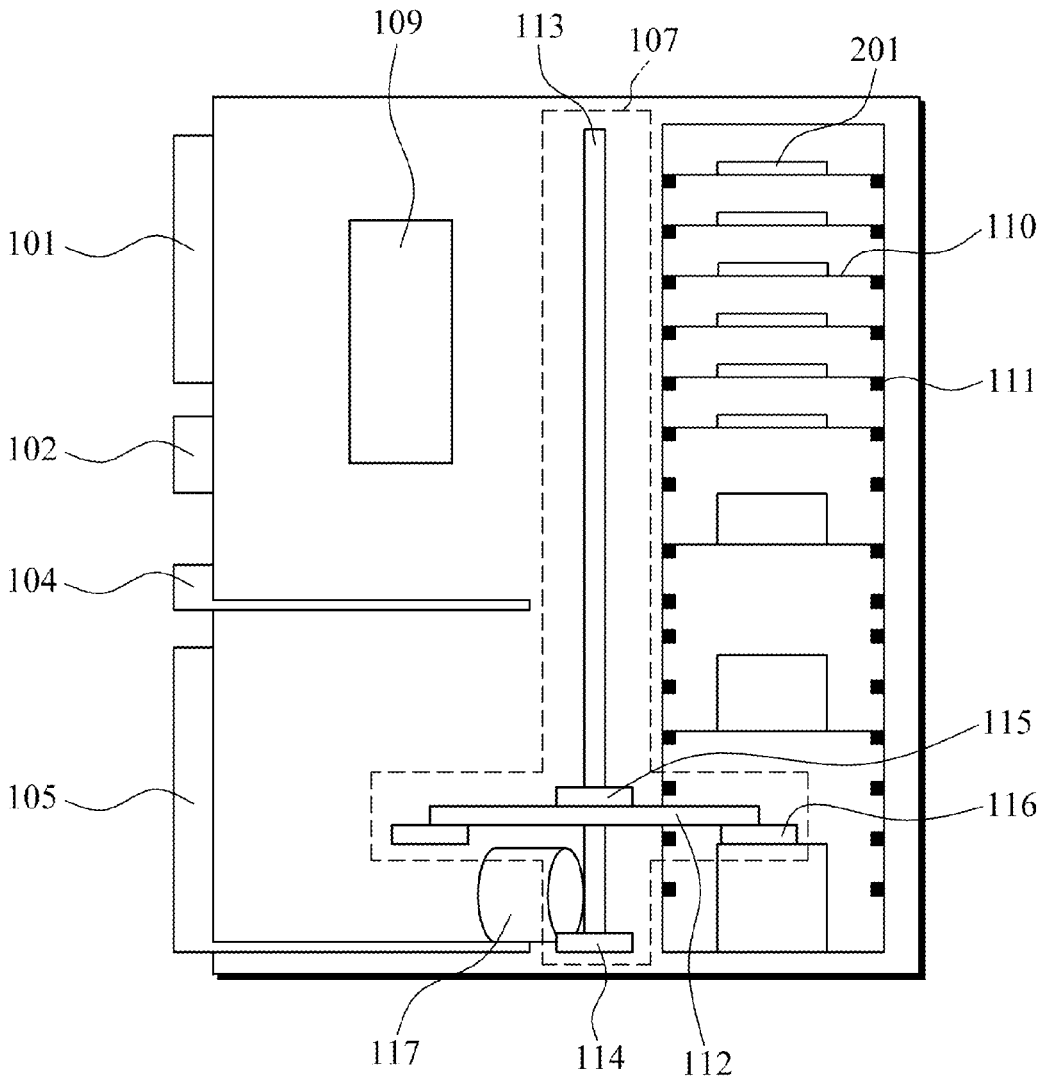
FIG. 1B is a side view of the unmanned parcel storage apparatus of FIG. 1A.

FIG. 1A is a front view of an unmanned parcel storage apparatus capable of dynamically allocating storage spaces according to an exemplary embodiment, and FIG. 1B is a side view of the unmanned parcel storage apparatus of FIG. 1A.

Referring to FIGS. 1A and 1B, the unmanned parcel storage apparatus may include a post slot 103, a storage unit 108, a moving unit 107, a control unit 109, an interface unit 101, and a power unit 117, and may further include a paper output tray 102.

The post slot 103 includes a mail slot 104 and a parcel slot 105. Regular-sized mails 201, such as letters and postcards, are slid into or discharged from the unmanned parcel storage apparatus through the mail slot 104, and larger delivery items, such as parcels and packages, are put into or discharged from the unmanned parcel storage apparatus through the parcel slot 105. The parcel slot 105 is provided to enable the large delivery items to be slid therethrough and thereby loaded into the unmanned parcel storage apparatus, and also to enable the loaded delivery items to be discharged therethrough. In order to increase user's efficiency in loading or receiving the delivery items 201, the separate slots are provided according to the size of delivery items, such as small-sized mails 201 including letters and envelopes, and larger-sized delivery items including parcels and packages.

The storage unit 108 is horizontally partitioned into several storage spaces by a plurality of partitions 110, which are fixedly supported by a plurality of partition rests 111. The storage unit 108 does not have storage spaces of fixed size, but can flexibly decide the number and size of the storage spaces depending on the loaded state of the delivery items 201. The partition rests 111 support the partitions 110 at the bottoms to fix them to the storage unit 108. The partition rests 111 are fastened at symmetrical positions on both sides of vertical walls 106 and at regular intervals from each other. The vertical walls vertically divide the storage unit 108 into the storage spaces. The partitions 110 will be described later in detail with reference to FIGS. 2A and 2B.

The control unit 109 manages the storage spaces of the storage unit 108 and the delivery items 201 loaded in the storage unit 108, and controls the movement of the moving unit 107. The control unit 109 identifies the number, sizes and positions of the current storage spaces prior to storing the delivery items 201. Based on information on the current storage spaces, the control unit 109 determines positions and sizes of newly created storage spaces. Then, the control unit 109 controls the moving unit 107 to move the partitions 110 and thereby create a new storage space or change the size of the existing storage space. In addition, the control unit 109 controls the moving unit 107 to move, load, or discharge the delivery items 201.

The interface unit 101 provides a user interface and information of the unmanned parcel storage apparatus so as to enable the user to operate the apparatus. The interface unit 101 may include a display device, such as a monitor screen, and an input device, such as a mouse and a keyboard. In addition, the interface unit 101 may include a device, such as a touch panel, which is integrated with display device and an input device. Moreover, the interface unit 101 may further include location area network (LAN) communication module or a wired communication module, such as a wire telephone, to enable transmission of deposit and reception history information to the user. The interface unit 101 provides the user with information regarding the currently stored delivery items 201 and the storage state and device state. Further, the user uses the user interface 101 to take procedures for storing or receiving the delivery items 201. The user interface 101 may inform the storage or reception result to another user via the embedded wired communication network.

The moving unit 107 may include a rotatable arm 112, a vertical driving unit 113 to move the rotatable arm 112 in a vertical direction, a horizontal driving unit 114 to move the vertical driving unit 113 and the rotatable arm 112 in a horizontal direction, a rotation unit 115 to rotate the rotatable arm 112, suction units 116 disposed on either end of the rotatable arm 112 to tightly grab the delivery item 201 via vacuum suction, the power unit 117 to supply power to the moving unit 107, and a guiding unit to guide the vertical movement and the horizontal movement of the rotatable arm 112.

The rotatable arm 112 may be fastened to the vertical driving unit 113, and may extend and compress to move forward and backward. The suction unit 116 can be placed above the delivery item 201 by means of such linear movement and rotation movement of the rotation unit 115.

The vertical driving unit 113 moves along the guiding unit to move the rotatable arm 112 in a vertical direction. The horizontal driving unit 114 moves along the guiding unit to move the vertical driving unit 113 in a horizontal direction. Both the vertical driving unit 113 and the horizontal driving unit 114 may use a driving device, such as a linear motor and a screw motor.

The moving unit 107 may enable to move the rotatable arm 112 in a vertical and/or a horizontal direction using the vertical driving unit 113 and/or the horizontal driving unit 114. The moving unit 107 moves the rotatable arm 112 to approach the desired delivery item 201 or the partition 110, and then the suction unit 116 disposed on either end of the rotatable arm 112 is placed above the desired delivery item 201 by the linear movement of the rotatable arm 112 and the rotational movement of the rotation unit 115. The suction unit 116 tightly grabs the desired delivery item 201 via vacuum suction. Then, the suction unit 116 is driven to the storage space to store the delivery items by the vertical driving unit 113 and/or the horizontal driving unit 114. The rotatable arm 112 linearly moves and rotates to place the delivery item 201 from the suction unit 116 to the storage space. Then, the rotatable arm 112 releases the vacuum suction to allow the delivery item to be loaded in the storage space.

The paper output tray 102 provides pieces of paper on which the information provided by the unmanned parcel storage apparatus is printed. The output information may include a variety of information, such as receipts or delivery notes for the deposit or receipt of the delivery items 201, information about the storage unit and the stored delivery items 201.

According to method of the unmanned parcel storage apparatus to dynamically creating the storage spaces for storing delivery items, the current allocation state of the storage spaces and the presence of the delivery items in each storage space are identified. The positions and sizes of new storage spaces are determined based on the identified information. The moving unit 107 moves to a desired position to add or remove a partition 110 and thereby create a storage space with a determined size. The moving unit 107 adds or removes the partition 110 in the same way as when loading or removing the delivery item. Specifically, the rotatable arm 112 rotates to place the suction unit 116 above the partition 110, the suction unit 116 lifts and tightly grabs the partition 110 by vacuum suction and it moves to the determined position along a vertical rail and/or a horizontal rail. After placing at the determined position, the rotatable arm 112 releases the vacuum suction to allow the partition 110 to seat on the partition rests 111. Accordingly, the unmanned parcel storage apparatus is able to store the delivery items 201 based on the sizes of the delivery items 201 and the current storage state of the items 201. Therefore, it may be possible to use the space of the storage unit efficiently.

Figure 2A:
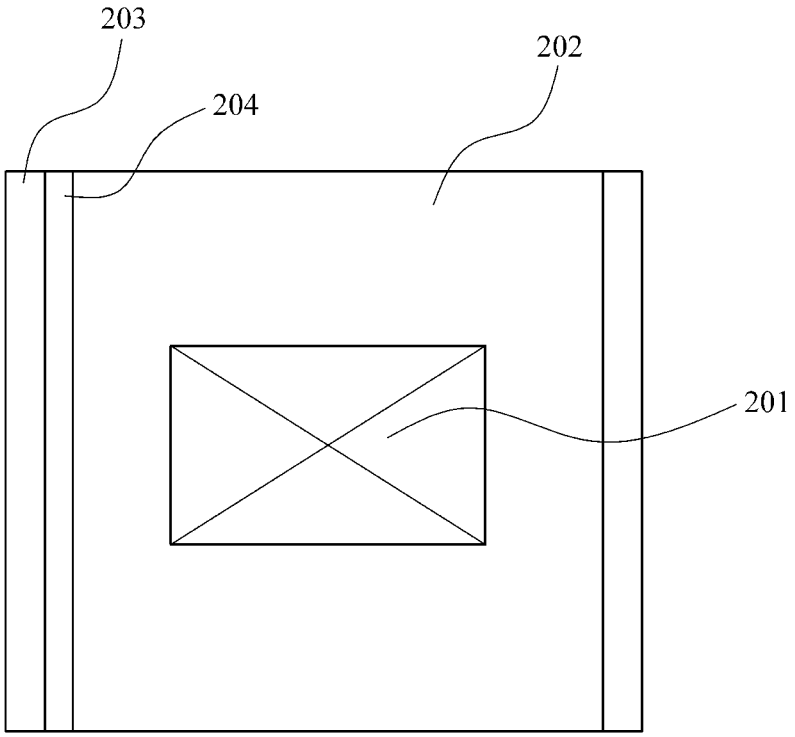
FIG. 2A is a top view of a partition according to an exemplary embodiment.
Figure 2B:
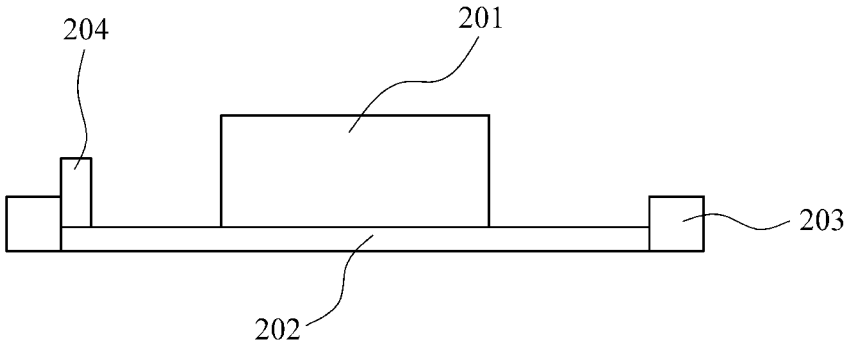
FIG. 2B is a cross-sectional view of the partition of FIG. 2A.

FIG. 2A is a top view of a partition according to an exemplary embodiment, and FIG. 2B is a cross-sectional view of the partition of FIG. 2A.

Referring to FIGS. 2A and 2B, the partition includes a partition floor 202 to support a delivery item 201, partition connectors 203 disposed at both sides of the partition floor 202 and configured to connect the partition and partition rests, and a partition vertical bar 204 adhered to a border between the partition floor 202 and one of the partition connectors 203 so as to prevent the delivery item 201 from falling. The partition connectors 203 are coupled to the partition rests of a storage unit so as to fasten the partition to the storage unit, and the partition decides the size of the storage space. The partition connectors 203 and the partition rests are not fixed to each other, but are detachable from each other in a vertical direction. The delivery item 201 is carried by the moving unit and loaded on the partition.

Figure 3:
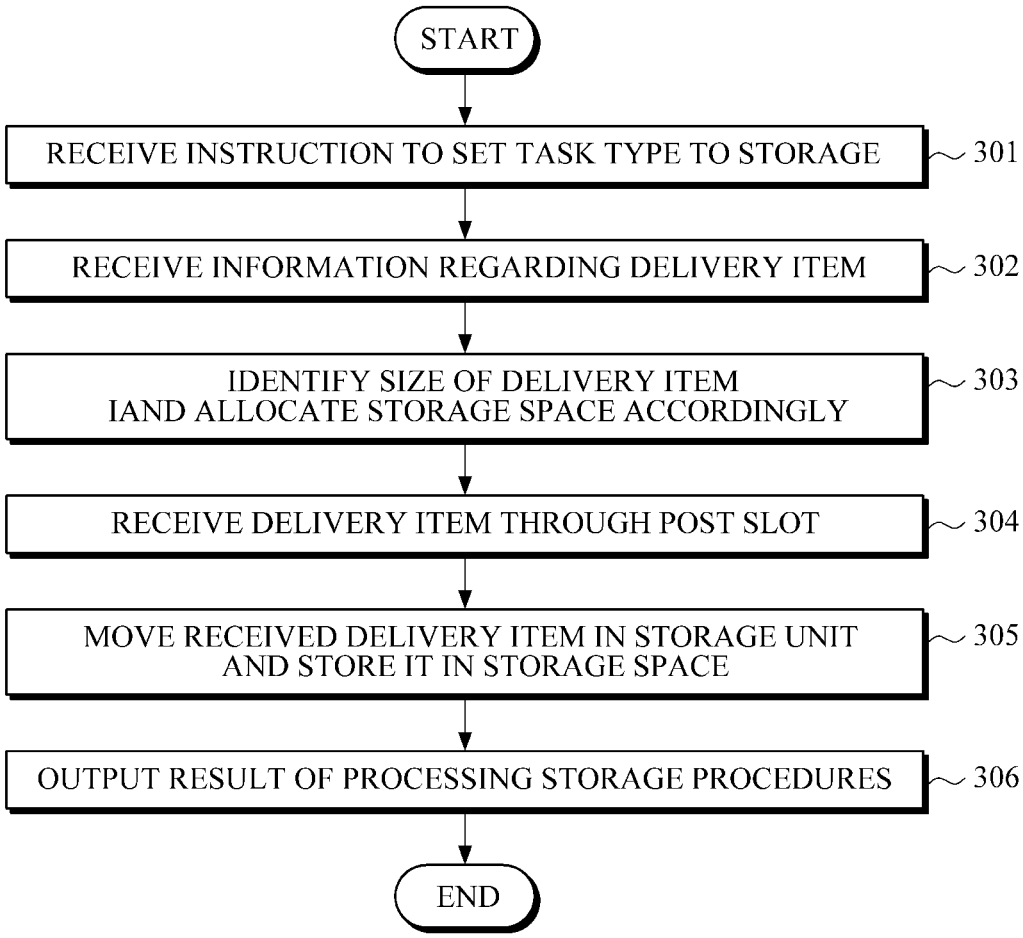
FIG. 3 is a flowchart illustrating a storage method of an unmanned parcel storage apparatus according to an exemplary embodiment.

FIG. 3 is a flowchart illustrating a storage method of an unmanned parcel storage apparatus according to an exemplary embodiment.

Referring to FIG. 3, the unmanned parcel storage apparatus receives an instruction from a user to set the task type of the apparatus to storage of a delivery item in 301. The unmanned parcel storage apparatus mainly carries out two tasks, storage and reception. The user may select the task type of the unmanned parcel storage apparatus according to the purpose of use. After the task type is selected, the apparatus receives information regarding the delivery item from the user in 302. The user who deposits the delivery item in the unmanned parcel storage apparatus may input personal information, such as his/her employment number, name and phone number, so as to identify the user. Then, the apparatus may receive information including at least one or more of sender information, a registry number, a delivery number, a type of item, a size of item, and recipient information. The input information is used for identifying a delivery person or a recipient at the time of receiving the delivery item.

Then, the apparatus recognizes the size of the delivery item and prepares a storage space in a storage unit for the item in 303. The apparatus which has received the information regarding the delivery item checks the number of the current storage spaces and the state of the storage unit that stores the existing delivery items in the storage spaces, before opening a post slot. Then, the apparatus allocates a storage space in the storage unit in consideration of the state of the storage unit and the size of the delivery item to be loaded. The apparatus uses a moving unit to adjust the positions of the partitions such that a storage space with a desired size is created at a desired position, and then opens the post slot. The post slot includes a mail slot and a parcel slot and both or either of the mail and the parcel slots is opened according to the size of the delivery item to be deposited.

Then, the apparatus receives the delivery item from the user through the open post slot in 304. The apparatus allocates the storage space for the delivery item, opens the appropriate post slot in consideration of the size of the delivery item, and receives the delivery item through the post slot. The apparatus classifies the received delivery item according to the size. When identifying that the size of the delivery item fails to conform to predefined criteria or is not possible to be moved by the moving unit, the apparatus outputs an error message through the interface unit or the paper output tray.

The apparatus moves the received delivery item to load it in the storage space in 305. After the identification of the delivery item, the apparatus moves the moving unit to the post slot, and lifts and tightly grabs the delivery item using the suction unit of the moving unit. The moving unit moves the grabbed delivery item to the previously allocated storage space, and loads the delivery item in the storage space.

Then, the apparatus outputs a result of processing the storage procedures through the interface unit and/or the paper output tray in 306. When the storage of the delivery item is completed, the apparatus may output the storage processing result through the interface unit and/or the paper output tray. The processing result may be informed to a recipient via a communication means, such as text messages.

Figure 4:
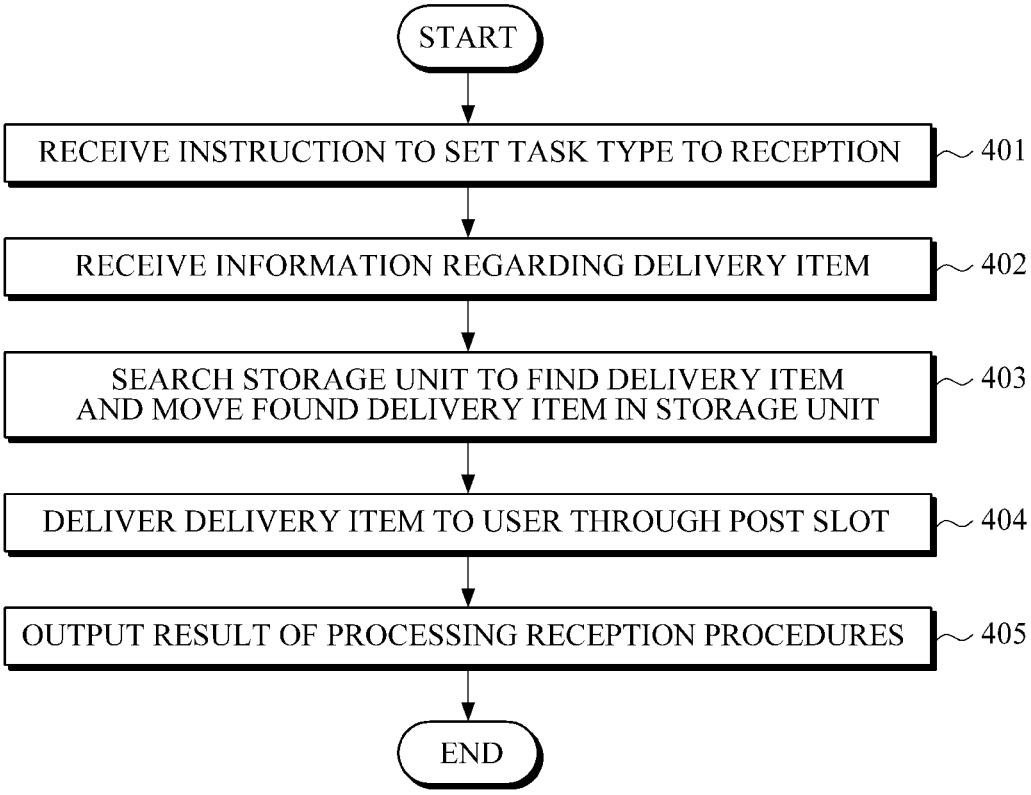
FIG. 4 is a flowchart illustrating a method of receiving a delivery item from an unmanned parcel storage apparatus according to an exemplary embodiment.

FIG. 4 is a flowchart illustrating a method of receiving a delivery item from an unmanned parcel storage apparatus according to an exemplary embodiment.

Referring to FIG. 4, the unmanned parcel storage apparatus receives an instruction from a user to set the task type of the apparatus to receiving of a delivery item in 401. The user needs to determine the task type of the unmanned parcel storage apparatus according to the purpose of use. After receiving the instruction to set the task type to reception, the apparatus receives information regarding the delivery item from the user in 402. The user may input information about a delivery item that the user wants to receive, and selects the delivery item from among the delivery items stored in the unmanned parcel storage apparatus. The information about the delivery item may include at least one or more of a registry number, a delivery number, an employee number, sender information and recipient information. In addition, the user may be assigned an ID number and password for the prevention of theft and the enhancement of security.

Then, the apparatus searches the storage unit to find the delivery item and moves the found delivery item using the moving unit in 403. When finding the postal time that the user wants to receive, the apparatus uses the moving unit to move the found delivery item to the post slot. Then, the delivery item is delivered to the user through the post slot in 404.

Then, the apparatus outputs the result of processing the reception procedures through the interface unit and/or the paper output tray in 405. Once the user receives the desired delivery item from the storage unit of the apparatus, the apparatus outputs the processing result through the interface unit and/or the paper output tray.

As apparent from the above description, delivery items are loaded in a number of storage spaces with different sizes which are allocated in real time according to the sizes of the delivery items, and thereby the efficient use of a storage unit can be realized, enabling to increase the number of delivery items to be stored in the same storage unit. Moreover, the allocation of the storage spaces, and processing of the delivery items, such as delivering, loading, and discharging of the delivery items, is automated by use of a moving unit, whereby the user convenience can be enhanced.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An unmanned parcel storage apparatus capable of dynamically allocating storage spaces, the apparatus comprising:

a post slot through which a delivery item is inserted and discharged;

a storage unit which comprises a plurality of movable partitions thereby defining a plurality of the storage spaces which are variable in size;

a control unit which dynamically allocates the storage spaces in the storage unit and determines disposition of the delivery item; and a moving unit which moves the partitions thereby adjusting the size of the storage spaces and moves the delivery item to the determined storage space in response to an instruction from the control unit.

2. The unmanned parcel storage apparatus of claim 1, wherein the post slot comprises a mail slot through which small delivery items are inserted and discharged, and a parcel slot through which large delivery items are inserted and discharged.

3. The unmanned parcel storage apparatus of claim 1, further comprising:

an interface unit to provide a user interface to allow a user to input information regarding the delivery item to the apparatus; and a paper output tray to output results of processing storage and/or reception of the delivery item and a receipt.

4. The unmanned parcel storage apparatus of claim 3, wherein the information regarding the delivery item includes at least one or more of an employee number, a delivery item's name, a recipient's name, a recipient's address, and a sender's name.

5. The unmanned parcel storage apparatus of claim 1, wherein the storage unit comprises the plurality of movable partitions to horizontally partition the storage unit into the plurality of storage spaces, and a plurality of partition rests to support the partitions to be detachably fixed to the storage unit.

6. The unmanned parcel storage apparatus of claim 1, wherein the moving unit comprises a rotatable arm with a suction unit at its end so as to fixedly grab the delivery item via vacuum suction, a rotation unit to rotate the rotatable arm, a vertical driving unit to vertically move the rotatable arm, a horizontal driving unit to horizontally move the rotatable arm, and a guide unit to guide vertical movement and horizontal movement of the rotatable arm.

* * * * *